US005273180A

United States Patent [19]

Whatley, Jr.

[11] Patent Number: 5,273,180

[45] Date of Patent: Dec. 28, 1993

[54] LIQUID STORAGE TANK LEAKAGE CONTAINMENT SYSTEM

[75] Inventor: Lonnie B. Whatley, Jr., Ardmore, Okla.

[73] Assignee: Spade Leasing, Inc., Springer, Okla.

[21] Appl. No.: 2,179

[22] Filed: Jan. 8, 1993

Related U.S. Application Data

[63] Continuation of Ser. No. 893,745, Jun. 5, 1992, abandoned, which is a continuation of Ser. No. 783,578, Oct. 28, 1991, abandoned, which is a continuation of Ser. No. 532,803, Jun. 4, 1990, abandoned.

[51] Int. Cl.[5] ..... B65D 25/00

[52] U.S. Cl. ..... 220/565

[58] Field of Search ..... 220/1.5, 565, 901, 465

[56] References Cited

U.S. PATENT DOCUMENTS

| | | | |
|---|---|---|---|
| 3,791,164 | 2/1974 | Laverman | 62/50 |
| 3,848,765 | 11/1974 | Dürkop | 220/9 A |
| 4,374,478 | 2/1983 | Secord et al. | 73/863.31 |
| 4,412,626 | 11/1983 | Gerhard | 220/1.5 |
| 4,591,064 | 5/1986 | Gerhard | 220/1.5 |
| 4,638,920 | 1/1987 | Goodhues, Jr. | 220/445 |
| 4,715,513 | 12/1987 | Shelton, Jr. | 220/469 |
| 4,787,772 | 11/1988 | Wagner | 405/53 |
| 4,805,445 | 2/1989 | Grappe | 73/49.2 |
| 4,871,081 | 10/1989 | Ershig | 220/5 A |
| 4,895,272 | 1/1990 | De Benedittis et al. | 220/85 S |
| 4,911,326 | 3/1990 | McGouran, Jr. | 220/445 |

*Primary Examiner*—Steven M. Pollard

*Attorney, Agent, or Firm*—Dougherty, Hessin, Beavers & Gilbert

[57] ABSTRACT

A tank leakage containment system which includes an open-topped containment tank of rectangular parallelepiped configuration, thus having a bottom, parallel end walls and parallel side walls. A pair of spaced saddle subassemblies project upwardly from the bottom wall and support a cylindrical fluid storage tank. The cylindrical storage tank has a capacity substantially less than the capacity of the open-topped containment tank, and lifting lugs are secured to the exposed upper side of the storage tank. The containment tank has skids mounted on the lower side thereof to facilitate movement across the ground, and has a towing bar extending across at least one end thereof.

4 Claims, 2 Drawing Sheets

LIQUID STORAGE TANK LEAKAGE CONTAINMENT SYSTEM

This is a continuation of applicant's copending application Ser. No. 07/893,745 filed on Jun. 5, 1992, now abandoned, which is a continuation of Ser. No. 07/783,578 (filed Oct. 28, 1991) now abandoned, which is a continuation of Ser. No. 07/532,803 (filed Jun. 4, 1990), now abandoned.

FIELD OF THE INVENTION

This invention relates to a storage tank leakage containment system which includes one tank mounted within a second, portable tank so as to contain leakage from the internal tank, and prevent a liquid from leaking therefrom so as to contaminate the environment.

BACKGROUND OF THE INVENTION

Brief Description Of The Prior Art

As concern for pollution of the environment has escalated in recent years, a myriad of regulations imposed by governmental authorities have restricted the methods by which liquids, and especially hydrocarbons, may be legally stored or retained in locations where any type of spillage is apt to contaminate or damage the environment. Such regulations have often included requirements that a redundantcy of containment be provided, whereby if a containing tank is ruptured or caused to spill, a secondary external tank or back up tank or second confining structure of some type will contain or receive the spillage, and keep it from being dispersed into the surrounding area where it may percolate down to contaminate ground water, or destroy surrounding vegetation.

In the case of above-ground storage, requirements have been imposed for placing an earthen containment dike around large metallic storage tanks, so that if the tanks are fractured or ruptured by earthquake, lightning or vandalism, or in some other way, the contents thereof are permitted to leak, such leaked liquids will be contained. The earthen pits thus formed are often required to be lined with a liquid impermeable liner, and the expense of construction of such facilities is high, and sometimes is prohibitively expensive in relation to the value of the objective to be served by placement of the storage tank at that location.

To meet these requirements, a number of systems have been developed which have frequently involved double tanks or double container systems in which one container is placed within another, so that the external container is capable of receiving and containing any liquid which may be spilled or discharged inadvertently from the internal tank. Among such systems which have been proposed, one is that which is shown in Goodhuse, Jr., U.S. Pat. No. 4,638,920. In the Goodhuse, Jr., patent, a cylindrical tank in which a liquid is stored is supported within a trapezoidally-shaped external container, and both are buried in an underground location. It is intended that this underground storage facility shall be placed permanently in the ground, and not moved, once it is constructed and installed at that location. The top of the external tank is closed and access thereto is provided by a removable manhole cover. It is necessary to go inside of the earth-surrounded external tank in order to effect repairs in the event the external tank becomes fractured or ruptured, or in some other way looses its liquid-tight integrity. No provision is made for the removal of the internal tank from the external tank, or for the skidding or other movement of the external tank from one location to another.

In Shelton, Jr., U.S. Pat. No. 4,715,513, a system is disclosed for containing a toxic material within a storage vessel. An external cylindrical jacket is provided which surrounds a toxic material-containing storage vessel, which may also be cylindrical. The external tank or jacket is generally made in two parts which can be joined together as half sections joined at a midplanar location. There is no provision for transporting or skidding the vessels, and in normal use, it is not contemplated that the internal and will be removed from the external jacket.

Wagner U.S. Pat. No. 4,787,772 relates to a generally rectangular containment tank which surrounds a cylindrical storage tank and catches leakage which may develop therefrom. The only thing which appears to support the internal tank within the external tank is the soil, since both are buried under the earth.

A vertically extending system for containing possibly toxic liquids is disclosed in U.S. Pat. No. 4,805,445. Here, the system includes an inner enclosure for containing the liquid to be stored, and an outer enclosure. Both are rigid and leak proof with one mounted inside the other and the two separated by an intermediate space. An upwardly extending neck opens the interior of the inner enclosure to access from above, and conduits extend through this neck to the interior of the inner enclosure for the purpose of charging and discharging the material to be stored in the inner enclosure. The bottom of the inner enclosure is supported above the bottom of the external enclosure by a pair of props or feet.

Durkop U.S. Pat. No. 3,848,765 relates to a double-walled tank. The inner tank is spaced upwardly off of the bottom of the outer tank by means of feet or spacers.

Ershig U.S. Pat. No. 4,871,081 relates to an inner vessel shell which is supported within a concentric outer vessel shell. A grid-lock support system separates the floor 24 of the inner shell from the floor 4 of the outer shell.

Numerous other patents exist which contemplate the provision of concentric tanks or shells with the inner tank being used for liquid storage.

BRIEF DESCRIPTION OF THE PRESENT INVENTION

The present invention provides a tank failure containment system which affords important advantages with respect to the types of liquid containment systems hereinbefore provided. First, the system need not be buried in the earth to function effectively. Second, the system requires no external earthen confinement construction, such as the construction of an earthen dike or pit within which the liquid storage tank is to be located, and thus, of course, it is not necessary to line such pit with an impermeable liner. The system of the invention is relatively economical to construct and is an essentially failsafe system which avoids the environmental contamination resulting from a fracture or breakage of a liquid storage tank, thereby unintentionally and unexpectedly releasing the liquid content thereof onto the surrounding area.

Broadly described, the tank-failure containment system of the invention comprises an external containment tank which is preferably of rectangular parallelepiped configuration and is mounted on skids, so that either the external tank alone, or the entire system, can be moved across the ground from one location to the other. Moreover, the generally flat bottom of the external containment tank facilitates the mounting of the system on a dolly or flat bed truck to permit it to be transported from one location to another.

A second major component of the fluid-containment system of the invention is an internal fluid storage tank which is either removably, or permanently, supported within the external tank in a way such that it is stable within the external containment tank, and can easily be placed therein by the use of available equipment such as cranes or large helicopters. The containment tank surrounds a major portion of the liquid storage tank, and is open at its top to permit ready access to any liquid spilled into the containment tank from the liquid storage tank. Also, since the containment tank is not buried in the earth, access to the outer side thereof is always available for effecting repairs, or for inspection. Suitably constructed charging and discharge lines extend from the internal fluid storage tank through the wall of the external containment tank, so that the contents of the storage tank can be continuously removed therefrom, or the storage tank can be recharged with additional liquid to be stored and periodically dispensed therefrom.

It is important that with slight alteration in construction, the system can be made so that the two principal parts thereof, i.e. the external containment tank and the internal liquid fluid storage tank can be separated from each other and moved to different locations as may be required for repair purposes, or for replacement of one component which may be damaged, or for any other reason. Alternatively, the two components may be married in construction so that they are permanently secured to each other. One cannot then be moved or thereafter separated from the other. In some situations, this is a desirable arrangement and such desideratum is accommodated by an alternate construction of the present invention.

From the foregoing description of the invention, it will be perceived that an important object of the invention is to provide a fluid storage system which is incorporated in a tank failure containment system which is environmentally safe to use, and which can be quickly and easily moved from one location to another.

Another important object of the invention is to provide an environmentally safe liquid storage system in the use of which, an external container which can be easily separated from the internal storage container is a spillage confinement tank which can be easily moved from one location to the other, either with the spilled liquid therein, or for purposes of simply relocating the entire system for operation at a different location.

In addition to the foregoing described objects and advantages of the invention, additional advantages and benefits of the use of the system will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
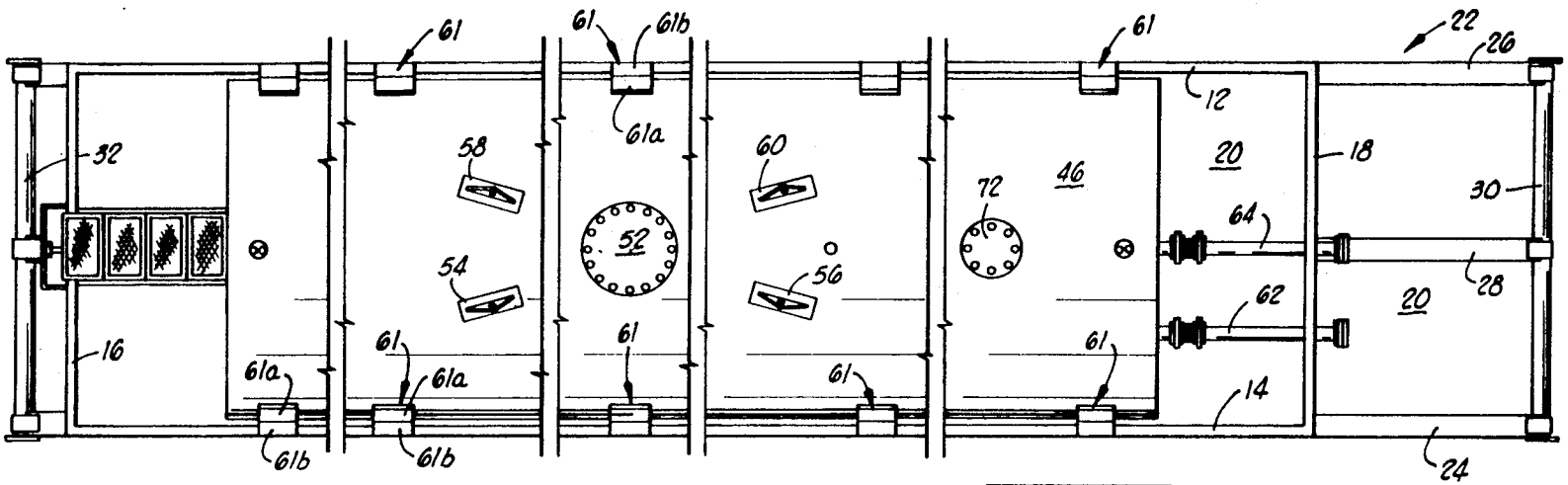
FIG. 1 is a plan view of the tank leakage containment system of the invention.
Figure 2:
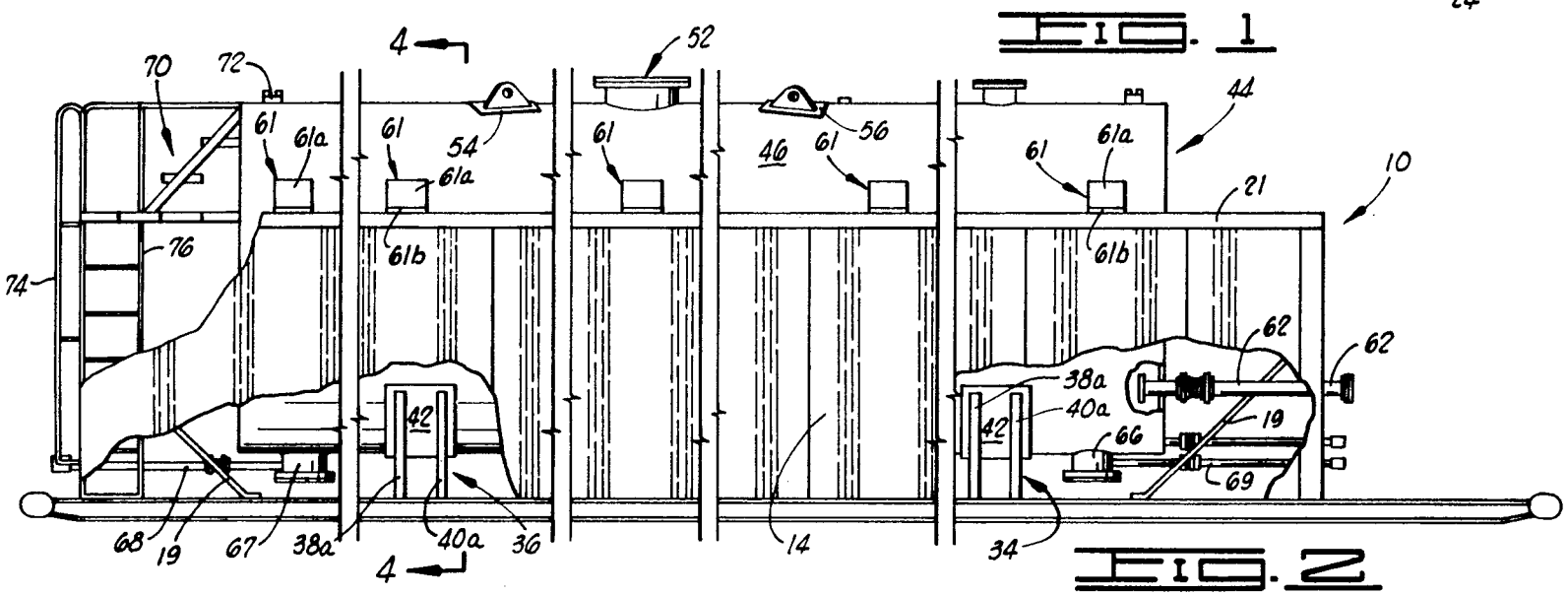
FIG. 2 is a side elevation view of the tank leakage containment system depicted in FIG. 1.
Figure 3:
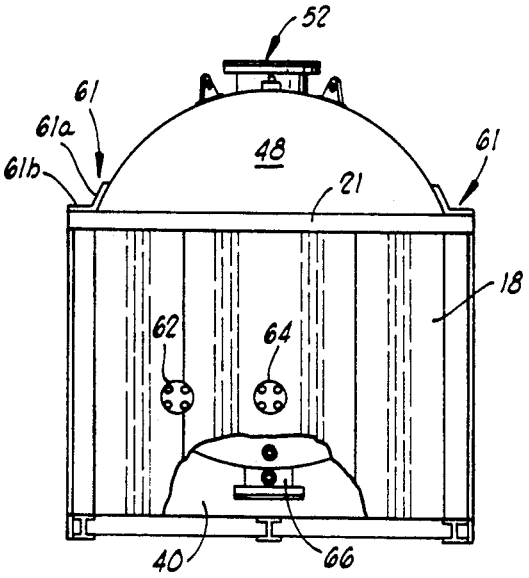
FIG. 3 is an end elevation view, with a part of the structure broken away, illustrating the tank leakage containment system.

Referring initially to FIGS. 1 and 2, the tank leakage containment system of the invention includes an open-topped containment tank 10 which is of rectangular parallelepiped configuration and forms an external tank of the system. The containment tank 10 includes a pair of opposed side walls 12 and 14, a pair of end walls 16 and 18 and is closed by a suitable bottom 20 (see FIGS. 1 and 4). A group of diagonal reinforcing or strength enhancing rods 19 are extended between the end walls 16 and 18 and the bottom 20. An angle iron cap plate 21 is extended around the entire periphery of the open top of the containment tank 10.

To facilitate movement of the leakage containment system from one location to another, a skid subassembly 22 is provided. The skid subassembly 22 includes a pair of parallel outer elongated I-beam skid elements 24 and 26, and a central elongated I-beam skid element 28. The elongated I-beam skids 24, 26 and 28 extend under the containment tank and project from opposite ends thereof as shown in FIG. 1. A transverse towing bar 30 interconnects the forward ends of the I-beam skid elements 26–28 and a transverse beam 32 interconnects the rear ends of the I-beam skid elements.

Figure 4:
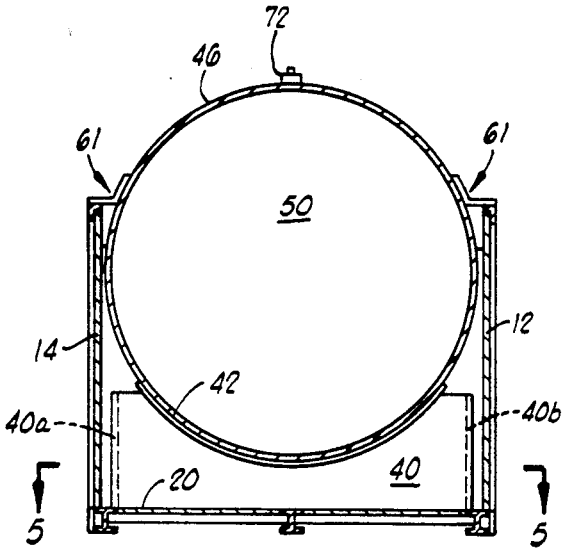
FIG. 4 is a sectional view taken along line 4—4 of FIG. 2.
Figure 5:
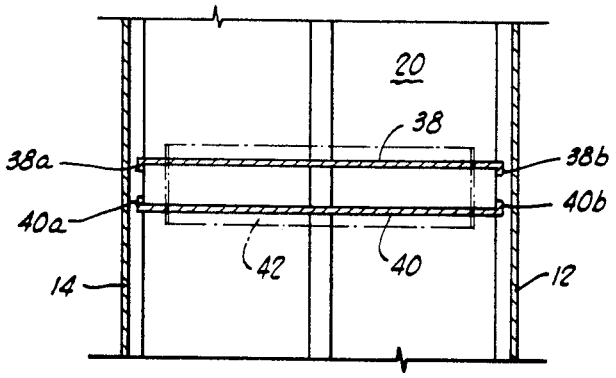
FIG. 5 is a sectional view taken along line 5—5 of FIG. 4.

Positioned within the containment tank 10 are a pair of horizontally spaced support cradles or saddle subassemblies, denominated generally by reference numerals 34 and 36. These are best illustrated in FIGS. 2 and 4 of the drawings. The cradles or support saddle subassemblies 34 and 36 are spaced from each other along the length of the containment tank 10 and are located substantially equidistantly inwardly from the opposite end walls 16 and 18 of the tank. As will be hereinafter explained, the saddle subassemblies 34 and 36 may, in one embodiment of the invention, be secured to the bottom 20 of the containment tank 10, and in a different embodiment can be secured to a fluid storage tank set into the containment tank. In yet another, and preferred embodiment, the saddle subassemblies 34 and 36 may be secured to both the containment tank 10 and the storage tank as hereinafter described.

The support saddle subassemblies 34 and 36 are identically constructed. Each thus includes a pair of substantially parallel support plates 38 and 40 which support an arcuate or semicylindrical saddle plate 42 in arcuate recesses formed in the tops of the parallel support plates. The support plates 38 and 40 are each strengthened by a pair of end flanges 38*a* and 38*b*, and 40*a* and 40*b*, respectively, as shown in FIGS. 2 and 4.

A fluid-containing storage tank, designated generally by reference humeral 44, is supported within the containment tank 10. The fluid-containing storage tank 44 is cylindrical in configuration, and thus has an external .cylindrical wall 46 and a pair of opposed, parallel end walls 48 and 50. The storage tank 44 includes a conventional access manway 52. A plurality of lifting cleats or lugs 54, 56, 58 and 60 are secured to the top of the tank 44 in positions to allow the storage tank to be lifted by a crane or large helicopter and moved from one location to another, and set into, or in some cases, lifted out of, the containment tank 10.

In addition to the support provided to the storage tank 44 by the saddle subassemblies 34 and 36, the storage tank carries a plurality of angle-shaped support plates 61. The support plates 61 are secured to the opposite sides of the storage tank at axially spaced intervals therealong at locations just above a diametric plan which extends through the longitudinal axis of the storage tank 44 and parallel to the open top of the containment tank 10. The support plates 61 each have one flange 61*a* welded to the outer side of the storage tank 44, and a second flange 61*b* which extends horizontally and can be rested upon the angle iron cap plate 21 which extends around the upper side of the containment tank.

In order to permit the fluid contents of the storage tank 44 to be accessible from outside the containment tank 10, a plurality of charging and discharging pipes 62 and 64 are provided at the forward end of the tank and communicate with the interior of the tank. A pair of sump wells 66 and 67 are provided at the opposite ends of the storage tank 44 in the bottom side thereof, and drain lines 68 and 69 extend therefrom out through end walls 16 and 18 of the containment tank 10.

A ladderway subassembly 70 is secured to one end of the tank 44 and facilitates access to the upper side of the storage tank so that the tank can be entered via the manway 52, or repairs can be made to the upper side of the tank, or the contents of the tank can be gauged in any of the ways well understood in the art, such as via the sounding port 72. Additionally, the containment tank 10 carries an outside ladder 74 and an inside ladder 76 which function in cooperation with the ladderway subassembly 70 to provide access to all parts of the system.

In the utilization of the tank failure containment system of the invention, the manner in which the system is assembled and used can vary according to the needs of the user, the particular facilities which are available and other factors. In one mode of usage, the fluid storage tank 44 is made up in a permanently joined combination qr integrated assembly with the containment tank 10. In such case, the fluid storage tank 44 is lifted by means of the lifting lugs 54–60, utilizing a crane or large helicopter. In almost all instances, the fluid storage tank 44 will be lifted in this fashion while in an empty status, and will be set into the containment tank 10 until the rounded bottom side or belly of the fluid storage tank 44 rests upon the arcuate saddle plates 42 and the saddle subassemblies 34 and 36. It will be noted that in this position, the bottom side of the tank 44 is supported in a location spaced upwardly from the bottom 20 of the tank 10 so that access may be had to the bottom of the cylindrical liquid containment tank 44, if such should be needed or desired.

In one method of construction, the saddle subassemblies 34 and 36 will have already been welded or otherwise suitably secured in place at the illustrated spacing within the containment tank 10 prior to the time of placement of the storage tank therein. In another method of assembly of the entire storage tank system, the saddle subassemblies 34 and 36 may be welded to the underside of the fluid storage tank 44 and raised with the fluid storage tank to be set down into the containment tank 10 until the saddle subassemblies 34 and 36 rest upon the bottom 20 of the containment tank. At the time that the fluid storage tank 44 is lifted by means of the lifting lugs 54–60, and set into the containment tank 10, the angle-shaped support plates 61 secured to the opposed sides of the storage tank 44 will come to rest upon the elongated angle iron cap plate 21 which surrounds the open top of the containment tank. The support plates 61 thus function in supporting a substantial part of the total weight of the storage tank 44. The angle-shaped support plates 61 cooperate in this function with the saddle subassemblies 34 and 36. In the case of the latter subassemblies, the saddle plates 42 thereof function to transmit and equally distribute the weight of the storage tank 44 to the parallel plates 38 and 40 forming a part of the saddle subassemblies.

After the storage tank 44 has been placed in the described position within the containment tank 10, the connections of the discharge and loading pipes 62 and 64 can be formed to permit a stored liquid to be introduced into the storage tank, or removed therefrom, at the site where the liquid is to be stored and/or dispensed. The same is true of the connection of the sump drain lines 68 and 69 which can be established at this time. The tank 44 may simply be a storage tank, the contents of which are not to be removed or even lowered over an extended period of time, or it may be a tank which is in continuous use as a system for dispensing a liquid on a periodic basis.

In the mode of usage where it is desirable or preferred that the storage tank 44 and the containment tank 10 remain a permanently joined integrated system, the parallel plates 38 and 40 of the saddle subassemblies 34 and 36 are welded to the bottom of the containment tank 10 and to the bottom side of the storage tank 44. The angle-shaped support plates 61 will also be welded to the angle iron cap plate 21 in effecting such permanent joinder.

It should be pointed out at this juncture that an alternative mode of assembly and use of the tank failure containment system is to simply bolt the angle-shaped support plates 61 to the angle iron cap plate 21 with removable bolts and allow the bottom of the storage tank 44 to simply rest upon the arcuate saddle plates 42 of the saddle subassemblies 34 and 36. In this way, detachment of the storage tank 44 from the containment tank 10 can be quickly effected, and the storage tank then moved to a different location if this should be desirable at any time during the life of the system. For example, if a storage tank 44 should be fractured by lightning, or in some other way heavily damaged, it may be of advantage to be able to remove the storage tank from the containment tank 10 quickly and without any major expense, and then replace it with a new undamaged storage tank so as to continue service at the location where the containment tank has been initially placed After the storage tank 44 has been placed within the containment tank 10, and either permanently secured thereto, or removably secured thereto in one of the ways described, the entire system can be loaded on a suitable truck or dolly and trucked to the location where the storage tank is to be placed and serviced. A particularly useful application of this system is at airports where it is infeasible to excavate containment dikes to safeguard against spillage of the liquid contained in the storage tank, and where it may be desirable from time-to-time to shift the location of the system in order to allow for progressive changes, such as new runway construction, or the like.

After the system has been trucked to the site where it is to be placed in service, the system is lowered to the ground and final adjustment to a selected position can be made by reason of the skids which are mounted on the under side of the containment tank. A tractor can be employed to tow the entire system to the desired location. At this time, the storage tank can be filled with a liquid which is to be dispensed therefrom via the discharge pipe 62. Filling can be accomplished through the filling pipe 64 or even through the manway 52 if this should be desirable or necessary. The system will then remain on the site where it is to be initially placed in service until the need for the liquid contained in the storage tank is ended, or a greater need exists at another location, in which case the entire system can be moved to the new location.

As an alternative mode of assembly of the system, the containment tank may first be moved to the location where the system is to be placed in service. The cylindrical fluid storage tank can then be trucked to that location, and a suitable crane or large helicopter can be used to engage the lifting lugs 54–60 to lift the storage tank upwardly and set it down in the containment tank 10 in the manner hereinbefore described. As previously pointed out, the securement of the storage tank in the containment tank can be permanent, or it may be only temporary in contemplation of future separation from each other of these two major components of the system for reasons which have been enumerated above, or for other reasons which will be apparent to those having ordinary skill in the art.

The tank failure containment system of the invention afford many advantages over the alternatives which might be used were this system of the invention not available. Thus, under present governmental requirements relative to storage of liquids and metallic or fiberglass storage tanks, a double-walled containment system or the equivalent is often required. Further, in some instances, where single-walled storage is permitted, an earthen dike must be built entirely around the storage tank to form a containment pit having an adequate capacity to retain all of the liquid which may be spilled or lost from that storage tank in the event of a catastropic failure of the tank. The earthen dike must usually have sufficient additional capacity to hold the additional amount of liquid deposited therein by heavy rains should this occur prior to the time the spilled contents of the tank can be recovered or removed to a different location. In the use of the system of the present invention, there is no need to undertake an expensive earth excavation and construction of an earthen dike for containment purposes, and the earth need not be disturbed at all at the location where the system is to be used. When use of the system has been completed, it can be easily removed from the site with no visible evidence of its having been utilized at that location.

As pointed out above, the containment tank 10 is volumetrically dimensioned so that it is capable of containing the entire liquid contents of the storage tank 44 if this tank should break or rupture as a result of earthquake, structural damage or excessive expansion of the contents, lightning strikes or for any other reason In fact, as a safety factor against such possibilities as heavy rainfall at the time of, or following, a rupture or failure of the storage tank 44, the containment tank 10 will usually have at least 110% of the capacity of the storage tank. The liquid is thus not permitted to spill over on the ground to thereafter percolate down and contaminate ground waters, or run off into surface streams or simply cause devastation of vegetation in the surrounding area. All of the content of the storage tank is contained in the tank 10 upon spillage of the storage tank. The open top of the containment tank allows access to be had to the spilled liquid in the event it is desired to lower the level of the liquid by pumping some or all of it into standby tanks prior to the time that the storage tank is to be repaired, either while in place or after removal. Usually, however, a drain pipe 80 which communicates with the interior of the containment tank 10 is used for the removal of the spilled liquid from the containment tank. It is also possible, of course, to tow the entire system by means of the transverse towing bar 30 and the I-beam skids 24–28 to another location where the spilled contents from the tank 44 may be removed more conveniently or more safely.

Many other advantages of the system of the invention will become apparent to those who are confronted with the necessity to accomplish liquid containment and storage in compliance with governmental regulations requiring adequate and frequently expensive safeguards against spillage or loss of liquid to the environment.

Although a preferred embodiment of the invention has been herein described, it will be understood that various changes and innovations can be made in the described system without departure from the basic principles upon which the invention is based. Changes and innovations of this type are therefore deemed to be circumscribed by the spirit and scope of the invention, except as the same may be necessarily limited by the appended claims, or reasonable equivalents thereof.

What is claimed is:

1. A portable tank leakage containment system comprising:

an open-topped, external containment tank of right parallelepiped configuration having a bottom, an underside on the outside of said bottom and confining side wall means, said confining side wall means including a pair of opposed, vertically extending, substantially parallel side walls defining the width of the opening at the top of said external containment tank and interconnected by said bottom;

means mounted to said underside of said external containment tank for facilitating movement of said external containment tank and its contents from one location to another;

saddle means supported on said bottom of said external containment tank on the inside thereof and extending upwardly from said bottom, said saddle means including two spaced saddle subassemblies, each of said saddle subassemblies including:

a pair of spaced, substantially parallel support plates each having a lower portion secured to said bottom of said external containment tank, and each having an arcuate recess formed in the top thereof; and an arcuate saddle plate secured to said substantially parallel support plates positioned in said arcuate recesses formed in the top thereof, for supporting an internal fluid storage tank;

a cylindrical internal fluid storage tank disposed at least partially within said external containment tank and resting on said arcuate saddle plates of said saddle subassemblies and having a top portion projecting above the open top of said external containment tank, said internal fluid storage tank having a lesser capacity than said external containment tank and having a smaller diameter than the distance of separation which extends between said opposed, vertically extending, substantially parallel side walls of said external containment tank, said internal fluid storage tank being sized to provide a space between said internal fluid storage tank and said external containment tank adequate to permit external inspection of the external wall of the internal fluid storage tank by a person inside the containment tank;

lifting means secured to said top portion of said internal fluid storage tank projecting above the open top of said external containment tank to facilitate lifting said internal fluid storage tank into, or out of, said external containment tank and for selectively placing the two in operative relationship to each other so that said internal fluid storage tank rests upon said saddle plates, said lifting means comprising a plurality of spaced, lifting lugs secured to said top portion of said internal fluid storage tank;

an angle iron cap plate extending around the upper side of said external containment tank around the open top thereof; and a plurality of spaced angle-shaped support plates each having:

a first part secured to said internal fluid storage tank; and a second part resting on said angle iron cap plate and transmitting a portion of the weight of said internal fluid storage tank and its contents to said external containment tank through said angle-shaped support plates.

2. A portable tank leakage containment system comprising:

an open-topped, external containment tank of right parallelepiped configuration having a bottom, an underside forming the outer surface of said bottom, a pair of opposed, longitudinally spaced, parallel end walls, and a pair of opposed, vertically extending, substantially parallel side walls defining the width of the opening at the top of said external containment tank;

means mounted to said underside of said external containment tank for facilitating movement of said external containment tank and its contents from one location to another;

saddle means supported on said bottom of said external containment tank on the inside thereof and extending upwardly from said bottom, said saddle means including two spaced saddle subassemblies, each of said saddle subassemblies including:

a pair of spaced, substantially parallel support plates each having a lower portion secured to said bottom of said external containment tank, each of said support plates being shorter in length than the distance between said parallel side walls of said external containment tank so as to be spaced therefrom, and each of said support plates having an arcuate recess formed in the top thereof; and an arcuate saddle plate secured to said substantially parallel support plates and positioned in said arcuate recesses formed in the top thereof, and adapted to support an internal fluid storage tank;

a cylindrical internal fluid storage tank disposed at least partially within said external containment tank and resting on said saddle plates of said saddle subassemblies and having a top portion projecting above the open top of said external containment tank, said internal fluid storage tank having a lesser capacity than said external containment tank and having a smaller diameter than the distance of separation which extends between said opposed, vertically extending, substantially parallel side walls of said external containment tank, said internal fluid storage tank being sized to provide a space between said internal fluid storage tank and said external containment tank adequate to permit external inspection of the outer side of said internal fluid storage tank by a person inside said external containment tank;

lifting means secured to said top portion of said internal fluid storage tank projecting above the open top of said external containment tank to facilitate lifting said internal fluid storage tank into, or out of, said external containment tank and for selectively placing the two in operative relationship to each other so that said internal fluid storage tank rests upon said saddle plates, said lifting means comprising a plurality of spaced, lifting lugs secured to said top portion of said internal fluid storage tank;

an angle iron cap plate extending around the upper side of said external containment tank around the open top thereof;

a plurality of spaced angle-shaped support plates each having:

a first part secured to said internal fluid storage tank; and a second part resting on said angle iron cap plate and transmitting a portion of the weight of said internal fluid storage tank and its contents to said external containment tank through said angle-shaped support plates;

an external ladder extending from substantially the level of said bottom of said external containment tank up to the top of one of said end walls of said external containment tank and located outside said external containment tank;

internal ladder means extending from said bottom of said external containment tank upwardly to said top portion of said internal fluid storage tank, said internal ladder means including:

a vertically extending internal ladder extending from said bottom of said external containment tank upward to the top of one end wall of said external containment tank, and terminating in an upper end located adjacent the upper end of said external ladder, whereby access to said bottom of said external containment tank can be had by climbing up said external ladder to the top of said external containment tank, then climbing down said vertically extending internal ladder to said bottom of said external containment tank to thereby gain access to the space between said external containment tank and said internal fluid storage tank; and an inclined ladder extending from said one end wall of said external containment tank upwardly and rearwardly to said top portion of said internal fluid storage tank whereby said top portion of said internal fluid storage tank can be reached by way of said external ladder and said inclined ladder without the necessity for descending into said external containment tank, or alteratively, said top portion of said internal fluid storage tank can be reached from the bottom of said external containment tank by way of said vertically extending internal ladder and said inclined ladder.

3. A portable tank leakage containment system comprising:

an open-topped external containment tank of right parallelepiped configuration and having a bottom, an underside forming the outer surface of said bottom, a pair of substantially parallel, longitudinally spaced opposed end walls, and a pair of substantially parallel longitudinally extending opposed side walls defining the width of the opening at the top of said external containment tank;

a cylindrical internal fluid storage tank positioned at least partially within said external containment tank, having a top portion projecting above the open top of said external containment tank and having all of its walls spaced from said external containment tank, said internal fluid storage tank having a diameter which is less than the distance between said substantially parallel opposed side walls of said external containment tank;

a pair of spaced, parallel elongated skids secured to said underside of said external containment tank;

a towing bar secured to said skids at a location spaced outwardly from said underside of said external containment tank;

means for supporting said internal fluid storage tank within said external containment tank so that more than one-half of the total volumetric extent of said internal fluid storage tank is located within said external containment tank, said internal fluid storage tank being spaced upwardly from said bottom of said external containment tank so that a person can have sufficient space to more beneath said internal fluid storage tank by entering a space between said internal fluid storage tank and said bottom of said external containment tank, said means for supporting said internal fluid storage tank within said external containment tank including two spaced saddle subassemblies, each of said saddle subassemblies including:

a pair of spaced, substantially parallel support plates each having a lower portion secured to said bottom of said external containment tank, and each having an arcuate recess formed in the top thereof; and an arcuate saddle plate secured to said substantially parallel support plates and positioned in said arcuate recesses formed in the top thereof, said saddle plates of said saddle subassemblies each being matched to the external circumferential configuration of said internal fluid storage tank and supporting said internal fluid storage tank in a position spaced upwardly from said bottom of said external containment tank;

a plurality of lifting lugs secured to said top portion of said internal fluid storage tank to facilitate lifting said internal fluid storage tank into, or out of, said external containment tank and to facilitate working on said top portion of said containment tank without easily slipping off of the internal fluid storage tank;

an angle iron cap plate extending around the upper side of said external containment tank around the open top thereof;

a plurality of spaced, L-shaped support plates each having:

a first part secured to said internal fluid storage tank; and a second part resting on said angle iron cap plate and transmitting a portion of the weight of said internal storage tank and its contents to said external containment tank through said L-shaped support plates;

an external ladder extending from substantially the level of said bottom of said external containment tank up to the top of said external containment tank and located outside said external containment tank;

an internal ladder extending from said bottom of said external containment tank upwardly to the top of said external containment tank at a location near the top of said external ladder; and a ladder subassembly inclined and having a lower end accessible by way of said external ladder and by way of said internal ladder and having its upper end adjacent said top portion of said internal fluid storage tank.

4. A portable tank leakage containment system as defined in claim 3 and further characterized as including liquid charging and discharging pipes extending from said internal fluid storage tank out through said external containment tank to the outer side thereof.

* * * * *

UNITED STATES PATENT AND TRADEMARK OFFICE

CERTIFICATE OF CORRECTION

Patent No.: 5,273,180

Dated: December 28, 1993

Inventor(s): Lonnie B. Whatley, Jr.

It is certified that error appears in the above-identified patent and that said Letters Patent is hereby corrected as shown below:

Column 5, line 25, delete "in" and substitute --on-- therefor;

Column 5, line 45, delete "qr" and substitute --or-- therefor; and

Column 11, line 39, delete "more" and substitute --move-- therefor.

Signed and Sealed this

Third Day of May, 1994

Bruce Lehman

*Attest:*

BRUCE LEHMAN

*Attesting Officer*

*Commissioner of Patents and Trademarks*